US010486892B1

(12) United States Patent
Cassoni et al.

(10) Patent No.: US 10,486,892 B1
(45) Date of Patent: Nov. 26, 2019

(54) PACKAGES AND ARRAYS OF PACKAGES FOR PLASTIC AEROSOL DISPENSERS

(71) Applicant: The Procter & Gamble Company, Cincinnati, OH (US)

(72) Inventors: Robert Paul Cassoni, Waynesville, OH (US); David Andrew Dalton, Mason, OH (US); Philip Andrew Sawin, Cincinnati, OH (US); Kerry Lloyd Weaver, Florence, KY (US); Douglas Bruce Zeik, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/108,176

(22) Filed: Aug. 22, 2018

(51) Int. Cl.
*B65D 83/62* (2006.01)
*B65D 83/20* (2006.01)
*B65D 83/38* (2006.01)

(52) U.S. Cl.
CPC ..... *B65D 83/384* (2013.01); *B65D 83/205* (2013.01); *B65D 83/62* (2013.01)

(58) Field of Classification Search
CPC ..... B65D 83/384; B65D 83/205; B65D 83/62
USPC ..... 222/402.1–402.25
See application file for complete search history.

(56) References Cited

U.S. PATENT DOCUMENTS 2,676,060 A * 4/1954 Montenier ..... A61M 11/02 239/327
4,322,037 A * 3/1982 Heeb ..... B65D 83/48 239/337
4,694,975 A * 9/1987 Hagan ..... B67D 1/0456 215/4
7,014,127 B2 * 3/2006 Valpey, III ..... B65D 83/48 222/402.1
8,074,847 B2 * 12/2011 Smith ..... B65D 83/38 222/394
8,579,158 B2 * 11/2013 Rice ..... B65D 83/62 222/105
8,869,842 B2 * 10/2014 Smith ..... B65B 31/025 141/3
8,985,113 B2 * 3/2015 Aldana ..... A61M 16/10 128/204.18
9,132,955 B2 * 9/2015 Smith ..... B65D 83/48
9,296,550 B2 * 3/2016 Smith ..... B65D 83/14
9,394,098 B2 * 7/2016 Kohls ..... B65D 83/48
(Continued)

*Primary Examiner* — Patrick M. Buechner
*Assistant Examiner* — Michael J. Melaragno
(74) *Attorney, Agent, or Firm* — Sarah M DeCristofaro; Abbey A Lopez

(57) ABSTRACT

A package and an array of packages for aerosol dispensers is provided. The package includes a polymeric outer container, the polymeric outer container having a closed bottom, a sidewall, a neck opposite the closed bottom and defining an opening for receiving product. The polymeric outer container has a longitudinal axis. The package has an attachment ring disposed adjacent to the neck of the outer container. The attachment ring has a radially outermost edge from the longitudinal axis that defines an outer diameter of the attachment ring. The outer diameter is 32.20 mm to 32.80 mm, and wherein the attachment ring is directly connectable with an actuator of an aerosol dispenser. The outer diameter of the attachment ring in the array of packages is 32.50 mm with a standard deviation of +/−0.30 mm.

19 Claims, 11 Drawing Sheets

(56) References Cited

U.S. PATENT DOCUMENTS 9,758,295 B2 * 9/2017 Smith ..... F16K 1/32
10,174,884 B2 * 1/2019 Smith ..... F16K 1/30
2002/0125270 A1 * 9/2002 de Pous ..... B05B 11/3049 222/153.09
2004/0262336 A1 * 12/2004 Kwasny ..... B65D 83/687 222/402.1
2009/0045222 A1 * 2/2009 Nimmo ..... B65D 83/0061 222/95
2009/0270546 A1 * 10/2009 Butuc ..... C08K 5/01 524/476
2010/0104611 A1 * 4/2010 Chan ..... A61K 8/11 424/401
2012/0288465 A1 * 11/2012 Loechel ..... A61K 8/046 424/70.28
2012/0292338 A1 * 11/2012 Smith ..... B65B 31/025 222/95
2013/0270295 A1 * 10/2013 Collias ..... B65D 1/40 222/95
2015/0033675 A1 * 2/2015 Smith ..... B65B 31/025 53/470
2015/0076164 A1 * 3/2015 De Cuyper ..... B65D 83/38 220/612
2015/0108163 A1 * 4/2015 Smith ..... B65D 83/14 222/95
2015/0108387 A1 * 4/2015 Smith ..... B65D 83/48 251/333
2015/0284117 A1 * 10/2015 Smith ..... B65B 31/025 53/411
2016/0167867 A1 * 6/2016 Smith ..... B65D 83/14 222/95
2016/0368700 A1 * 12/2016 Smith ..... B65D 83/48
2016/0376087 A1 * 12/2016 Smith ..... F16K 1/32 222/402.1
2016/0377186 A1 * 12/2016 Smith ..... F16K 3/26 251/325
2016/0377231 A1 * 12/2016 Smith ..... F16K 1/30 251/325
2017/0129690 A1 * 5/2017 Sugawara ..... B65D 83/38
2017/0166391 A1 * 6/2017 Smith ..... B65D 83/38
2017/0233171 A1 * 8/2017 Christianson ..... B65D 1/0223 222/402.13
2018/0043604 A1 * 2/2018 Zeik ..... B29C 49/22
2018/0044096 A1 * 2/2018 Neumann ..... B65D 83/44
2018/0044097 A1 * 2/2018 Zeik ..... B65D 83/384
2018/0099809 A1 * 4/2018 Smith ..... B65D 83/14
2018/0222613 A1 * 8/2018 Geier ..... B65B 31/028
2018/0222647 A1 * 8/2018 Geier ..... B65D 83/38
2018/0244460 A1 * 8/2018 Zeik ..... B65D 83/70
2018/0333920 A1 * 11/2018 Cassoni ..... B29C 66/73921
2018/0334276 A1 * 11/2018 Cassoni ..... B65D 83/38
2018/0334313 A1 * 11/2018 Smith ..... B65D 83/38
2018/0339841 A1 * 11/2018 Magness ..... B65D 83/205
2018/0339843 A1 * 11/2018 Cassoni ..... B65D 1/023
2018/0339844 A1 * 11/2018 Cassoni ..... B65D 83/38
2018/0370715 A1 * 12/2018 Smith ..... B65D 83/14

* cited by examiner

PRIOR ART

18

PRIOR ART

PRIOR ART

PACKAGES AND ARRAYS OF PACKAGES FOR PLASTIC AEROSOL DISPENSERS

FIELD

The present invention is directed to packages and arrays of packages for aerosol dispensers, and, more particularly, to packages and arrays of packages for plastic aerosol dispensers that allow for universal actuator attachment.

BACKGROUND

Aerosol dispensers typically comprise an outer container which acts as a pressure vessel for propellant and product contained therein. Outer containers made of metal are well known in the art. However, metal containers can be undesirable due to high cost and limited recyclability. Attempts to use plastic have been made.

The outer containers, either metal or plastic, are typically, but not necessarily, cylindrical. The outer container may comprise a closed end bottom adjoining a sidewall(s) and for resting on horizontal surfaces such as shelves, countertops, tables etc. The bottom of the outer container may comprise a re-entrant portion or base cup. The sidewalls define the shape of the outer container extend upwardly from the bottom to an opening at a top of the outer container.

With reference to FIG. 1, the opening 14 defines a neck 12 for receiving additional components of the aerosol dispenser. The neck 12 may include a crimp ring 16 at or near the top of the neck 12 that extends laterally outward for receiving and sealing a valve cup to the outer container 10. Industry has generally settled upon a nominal neck diameter of 25.35 mm+/−0.12 mm at the crimp ring 16, for standardization of components among various manufacturers, although smaller diameters, such as 20 mm, are also used. As illustrated in FIG. 1, an industry standard outer diameter of the crimp ring 16 is 31.55 mm+/−0.12 mm and height or thickness of the crimp ring 16 is 2.87 mm+/−0.10 mm.

With reference to FIG. 2, typically a metal valve cup 18 is inserted at least partially into the neck of a plastic or metal outer container. With reference to FIG. 3, the valve cup 18 is crimped against the crimp ring 16 to seal the outer container and prevent the escape of propellant, product, and loss of pressurization. The valve cup 18 may hold a valve and valve assembly which are movable in relationship to the balance of the aerosol dispenser. When the valve is opened, product may be dispensed through a nozzle, etc. As shown in FIG. 2, a valve cup 18 to be used with an industry standard outer container such as shown in FIG. 1 is sized to have an outer diameter of 32.50 mm, a nominal diameter of 25.15 mm+/−0.08 mm and a height where the valve cup meets the crimp ring of 5.30 mm+/−0.20 mm. A recommendation for calculating crimp dimensions uses the following equation:

$$H=2e+Jc+h$$

where e: thickness of ferrule

Jc: thickness of gasket

J: height of flange (not including sealing ring)

One industry standard reference for designing plastic aerosol dispensers is the FEA Standard, *Plastic Aerosol Dispensers Technical Requirements*, published February 2010, pages 1-7, X6-647E.

A valve may be inserted into the valve cup for selective actuation by the user. The valve is typically normally closed, but may be opened to create a flow path for the product to ambient or a target surface. The valve may be compatible with local recycling standards. The valve may be selectively actuated by an actuator. With reference to FIG. 4, an actuator 20 may be secured to the outer container 10 at the portion of the valve cup 18 sealed to the crimp ring 16 of the outer container 10. The actuator 20, such as shown in FIG. 4, may include a snap-fit connector to secure with the valve cup 18.

Attempts have been made to make the valve and/or valve cup from plastic. When making the valve and/or valve cup from plastic, new designs and methods may be needed to join the valve and/or valve cup with the outer container that are different than the methods used when sealing a metal valve cup to a plastic or metal outer container. Moreover, consideration of how the actuator will attach to the outer container with a different design is also needed. It would be particularly useful if actuators available today could be universally used for all plastic or substantially all plastic aerosol dispenser designs in order to avoid having to redesign the actuator to fit a new design due to the development and new mold costs.

Further, when manufacturing aerosol containers, and especially polymeric aerosol containers, the manufacturing tolerances are critical to for proper joining and sealing of components to maintain the aerosol dispenser under pressure.

As such, there is a need to develop a package for aerosol dispensers that can receive or be joined with universal, currently-available actuators.

Moreover, there is a need to develop a package for aerosol dispensers that is capable of achieving narrow manufacturing tolerances required for aerosol dispensers.

SUMMARY

A. An array of packages, wherein each package comprises:

a polymeric outer container, the polymeric outer container having a closed bottom, a sidewall, a neck opposite the closed bottom and defining an opening for receiving product, the polymeric outer container having a longitudinal axis, and an attachment ring disposed adjacent to the neck of the outer container, wherein the attachment ring has a radially outermost edge from the longitudinal axis the that defines an outer diameter of the attachment ring, wherein the attachment ring is directly connectable with an actuator of an aerosol dispenser, and wherein the outer diameter of the attachment ring in the array of packages is 32.50 mm with a standard deviation of +/−0.30 mm.

B. The array of packages of Paragraph A, wherein the attachment ring is integral with and extends from the neck of the polymeric outer container.

C. The array of packages of Paragraph A or Paragraph B, wherein each package further comprises:

a valve joined with opening of the polymeric outer container;

an actuator joined directly with the polymeric attachment ring; and a product delivery device disposed at least partially within the outer container, the product delivery device selected from the group consisting of a bag, a dip tube, a piston, and combinations thereof.

D. The array of packages of Paragraph C further comprising a polymeric valve cup connecting the valve with the polymeric outer container, wherein the polymeric valve cup comprises the attachment ring.

E. The array of packages of Paragraph D, wherein polymeric valve cup is spin-welded to the neck of the outer container.

F. The array of packages of any of Paragraphs A through E, wherein the standard deviation is +/−0.10 mm.

G. The array of packages of any of Paragraphs A through F, wherein the attachment ring has an upper surface and a lower surface disposed below the upper surface relative to the longitudinal axis, wherein the upper surface slopes downward toward the radially outermost edge.

H. The array of packages of any of Paragraphs A through G, wherein the attachment ring has an upper surface and a lower surface disposed below the upper surface relative to the longitudinal axis, wherein the upper surface has an axially uppermost point and the lower surface has an axially lowermost point, wherein an axial distance between the axially uppermost point and the axially lowermost point defines a height of the attachment ring, wherein the height is 3.60 mm to 4.40 mm, more preferably 3.90 mm to 4.10 mm.

I. The array of packages of any of Paragraphs C through H further comprising propellant disposed in the polymeric outer container and in operable relationship with the delivery engine.

J. The array of packages of any of Paragraphs A through I, wherein the actuator comprises a snap-fit connector that is releasably connectable with the attachment ring.

K. A package comprising:

a polymeric outer container, the polymeric outer container having a closed bottom, a sidewall, a neck opposite the closed bottom and defining an opening for receiving product, the polymeric outer container having a longitudinal axis; and an attachment ring disposed adjacent to the neck of the outer container, wherein the attachment ring has a radially outermost edge from the longitudinal axis the that defines an outer diameter of the attachment ring, wherein the outer diameter is 32.20 mm to 32.80 mm, and wherein the attachment ring is directly connectable with an actuator of an aerosol dispenser.

L. The package of Paragraph K, wherein the attachment ring is integral with and extends from the neck of the polymeric outer container.

M. The package of any of Paragraphs K through L, wherein each package further comprises:

a valve joined with opening of the polymeric outer container;

an actuator joined directly with the polymeric attachment ring; and a product delivery device disposed at least partially within the outer container, the product delivery device selected from the group consisting of a bag, a dip tube, a piston, and combinations thereof;

a polymeric valve cup connecting the valve with the polymeric outer container.

N. The package of any of Paragraphs K through M, wherein the outer diameter is 32.40 mm to 32.60 mm, and wherein the attachment ring has an axially uppermost point and an axially lowermost point, wherein an axial distance between the axially uppermost point and the axially lowermost point defines a height of the attachment ring, wherein the height is 3.60 mm to 4.40 mm, more preferably 3.90 mm to 4.10 mm.

O. The package of any of Paragraphs K through N, wherein the attachment ring has an upper surface and a lower surface disposed below the upper surface relative to the longitudinal axis, wherein the upper surface slopes downward toward the radially outermost edge.

DETAILED DESCRIPTION

Figure 1:
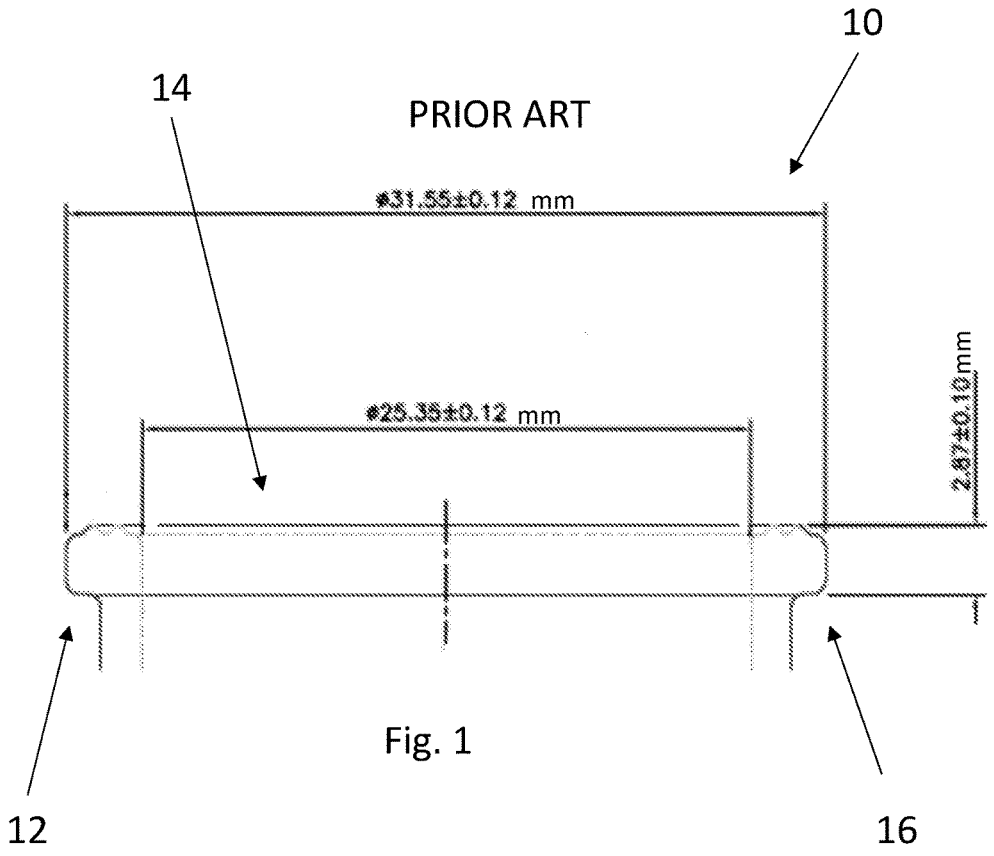
FIG. 1 is a sectional view of a prior art, industry standard crimp ring desk for a neck of an outer container for a plastic aerosol.
Figure 2:
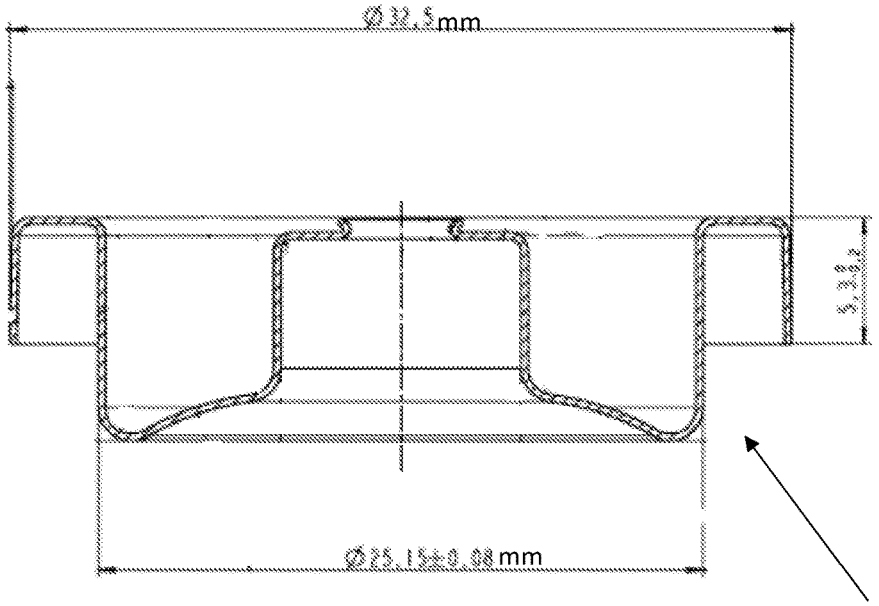
FIG. 2 is a sectional view of a prior art, industry standard valve cup design to be used with a plastic aerosol.
Figure 3:
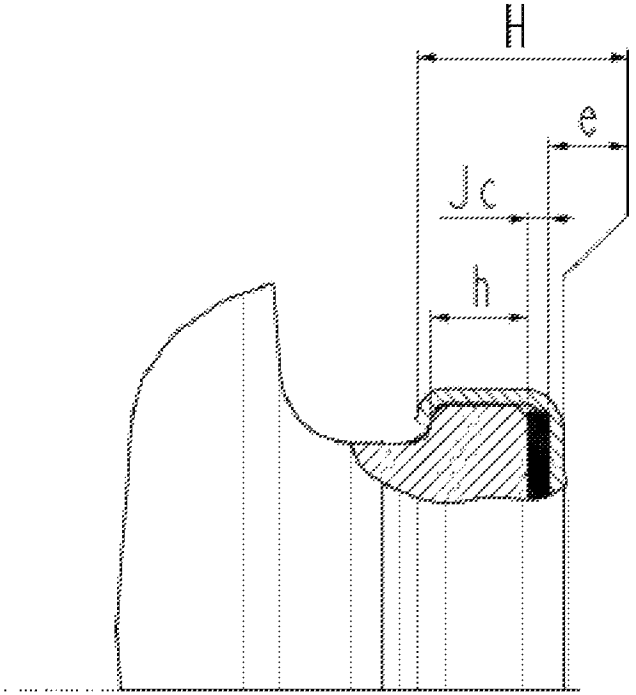
FIG. 3 is a partial sectional view of a prior art, industry standard aerosol dispenser having a plastic outer container having a crimp ring and a metal valve cup sealed to the crimp ring.

The present invention may be understood more readily by reference to the following detailed description of illustrative and preferred embodiments. It is to be understood that the scope of the claims is not limited to the specific products, methods, conditions, devices, or parameters described herein, and that the terminology used herein is not intended to be limiting of the claimed invention. Also, as used in the specification, including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent basis "about," it will be understood that the particular values form another embodiment. All ranges are inclusive and combinable. All percentages and ratios used herein are by weight of the total product, and all measurements made are at 25° C., unless otherwise designated.

The present invention is directed to a package or an array of packages for aerosol dispensers. Exemplary packages for aerosol dispensers may include an outer container for containing a product and a propellant, product delivery device, a valve, an actuator for selectively opening the valve, and a nozzle for controlling the spray characteristics of a product as it discharged from the aerosol dispenser. The package may also be in the form a preform that is configured to be blow-molded into an outer container.

Illustrative and non-limiting products include shave cream, shave foam, body sprays, body washes, perfumes, hair cleaners, hair conditions, hair styling products, antiperspirants, deodorants, personal and household cleaning or disinfecting compositions, air freshening products, fabric freshening products, hard-surface products, astringents, foods, paint, insecticides, etc.

The propellant may be selected from the group consisting of: hydrocarbons, compressed gas such as nitrogen and air, trans-1,3,3,3-tetrafluoroprop-1-ene, and mixtures thereof. The propellant may be selected from the group consisting of: compressed gas, trans-1,3,3,3-tetrafluoroprop-1-ene, and mixtures thereof. Propellant listed in the US Federal Register 49 CFR 1.73.115, Class 2, Division 2.2 are also considered acceptable. The propellant may particularly comprise a trans-1,3,3,3-tetrafluoroprop-1-ene, and optionally a CAS number 1645-83-6 gas. One such propellant is commercially available from Honeywell International of Morristown, N.J. under the trade name HFO-1234ze or SOLSTICE.

If desired, the propellant may be condensable. Generally, the highest pressure occurs after the aerosol dispenser is charged with product but before the first dispensing of that product by the user. A condensable propellant, when condensed, provides the benefit of a flatter depressurization curve at the vapor pressure, as product is depleted during usage. A condensable propellant also provides the benefit that a greater volume of gas may be placed into the container at a given pressure. A condensable propellant 40, such as HFO-1234ze, may be charged to a gage pressure of 100-400 kPa at 21 degrees C.

Figure 5:
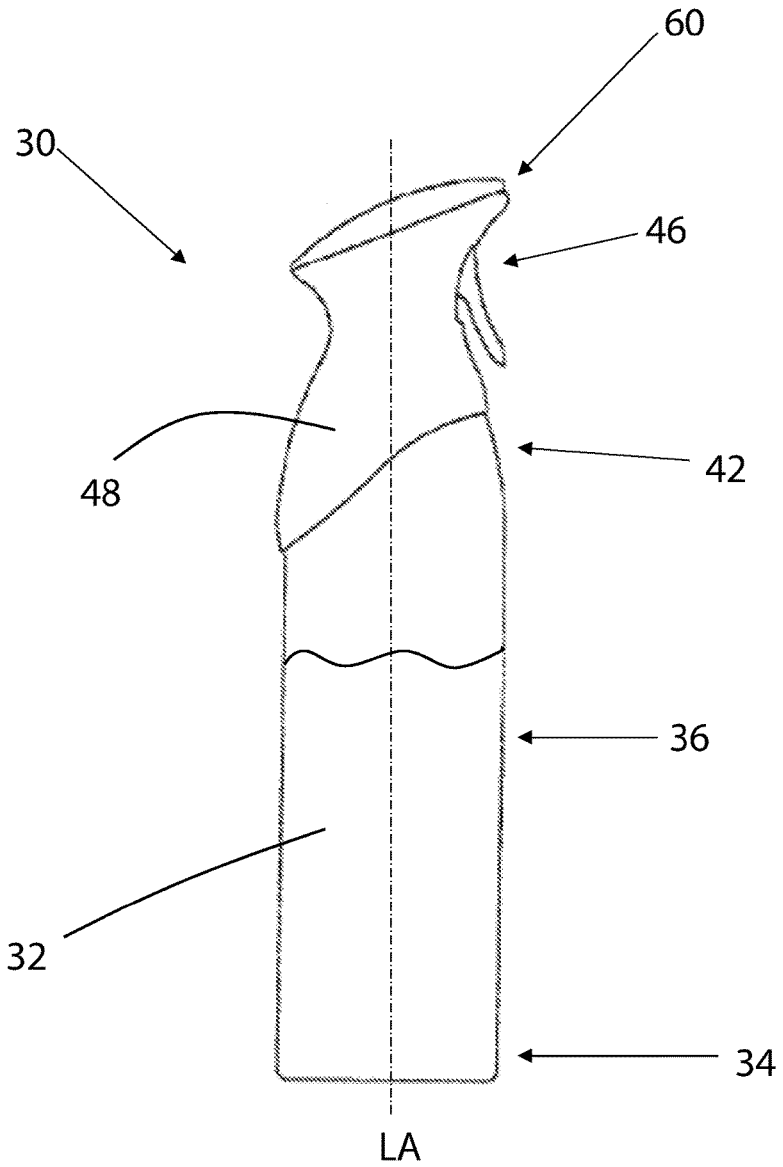
FIG. 5 is a side, elevation view of an aerosol dispenser.
Figure 6:
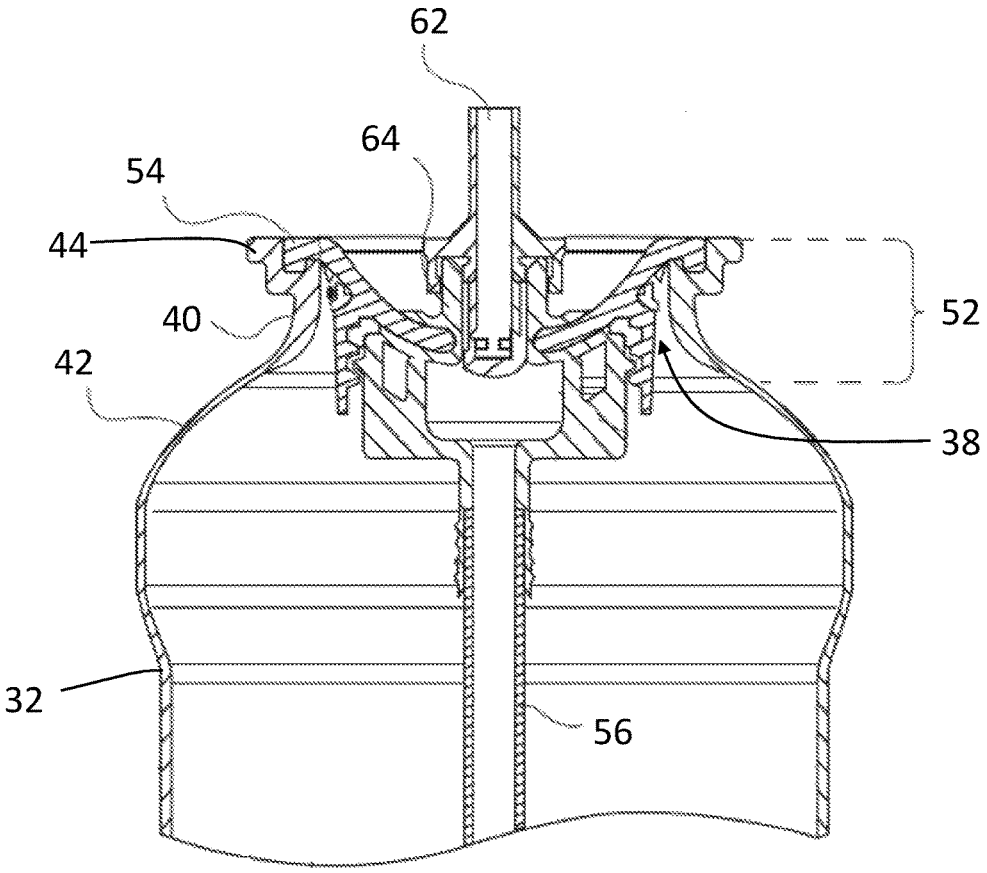
FIG. 6 is a partial sectional view of an aerosol dispenser having an attachment ring disposed on a neck of an outer container and having a dip tube as a product delivery device.

With reference to FIG. 5 or 6, an aerosol dispenser 30 may include an outer container 32, a valve 52, an actuator 46, and a product delivery device 56 disposed at least partially within the outer container. A product flow path begins in the outer container 32, extends to the product delivery device 56, through the valve 52, and terminates at a nozzle of an actuator 46. The aerosol dispenser 30 and outer container 32 have a longitudinal axis LA, defining the main axis.

The aerosol dispenser 30 and outer container 32 may be longitudinally elongate, i.e. having an aspect ratio of longitudinal dimension to transverse dimension[s] such as diameter greater than 1, an aspect ratio equal to 1 as in a sphere or shorter cylinder, or an aspect ratio less than 1.

The outer container 32 includes a closed bottom 34, one or more sidewalls 36, a neck 40 joined to the sidewall 36 at shoulder 42. The outer container 32 terms at an opening 38 opposite the bottom 34. The neck 40 and/or shoulder 42 may have a uniform or varying thickness in order to achieve a desired strength in these regions of the outer container 32.

Figure 7:
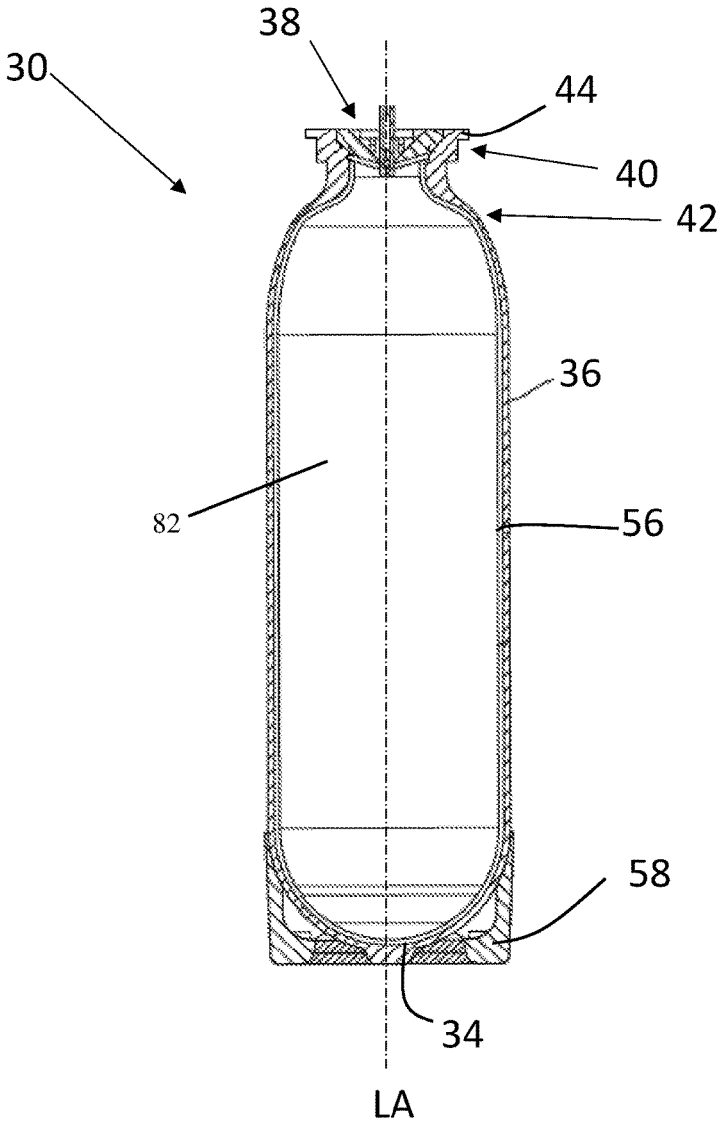
FIG. 7 is a sectional view of an aerosol dispenser having an attachment ring disposed on a neck of an outer container and having a bag as a product delivery device.

With reference to FIG. 7, the outer containers 32, either metal or plastic, are typically, but not necessarily, cylindrical. The bottom 34 may be configured for resting on horizontal surfaces such as shelves, countertops, tables etc. The bottom 34 of the outer container 32 may comprise a re-entrant portion or base cup 58. The sidewalls 36 define the shape of the outer container 32 extend upwardly from the bottom 34 to an opening 38 at the opposite end of the outer container 32.

The outer container 32 may comprise plastic. The plastic may be polymeric, and particularly comprise polyethylene terephthalate (PET) or polypropylene (PP) for all of the components described herein. The outer container 32 may be injection molded or further blow molded in an ISBM process, as well known in the art.

With reference to FIG. 5 or 6, the neck 40 is configured to receive a valve 52 and/or a valve cup 54. A valve 52 inserted at least partially into the neck 40 of the outer container 32. The valve cup 54 is sealed to the neck of the outer container 32 to prevent the escape of propellant, product, and, subsequently, the loss of pressurization. The valve cup 54 may be joined with the valve 52. The valve 52 may be movable in relationship to the balance of the aerosol dispenser 32 in order to open and close for dispensing product. When the valve 52 is opened, by way of the actuator 46, a flow path is created for the product to be dispensed through a nozzle 60 to ambient or a target surface. The valve 52 may be opened by selective actuation of the actuator 46 by a user.

With reference to FIG. 6, the valve cup 54 may be sealed to the outer container 32 utilizing a press fit, interference fit, solvent welding, laser welding, sonic welding, ultrasonic welding, spin welding, adhesive or any combination thereof. An intermediate component, such as a sleeve or connector may optionally be disposed intermediate the valve cup 54 and neck 40 or top of the outer container 32. Any such arrangement is suitable, so long as a seal adequate to maintain the pressure results.

A valve stem 62 provides a product flow path to the nozzle 50 and joins the actuator 46 to the valve 52. The valve stem 62 may be disposed within and cause responsive movement in a moving assembly 64.

With reference to FIG. 5, the actuator may include a nozzle 60 that directs product out of the aerosol dispenser and into the environment or onto a target surface. The nozzle may be configured in various different ways depending upon the desired dispensing and spray characteristics.

Figure 8:
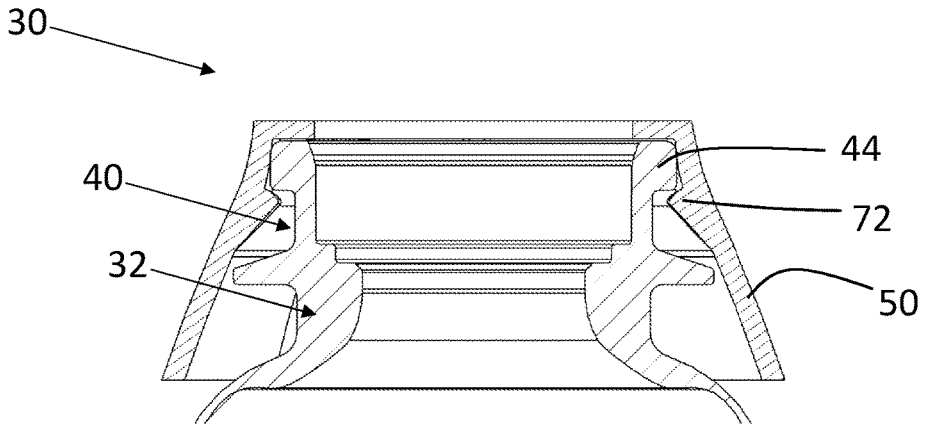
FIG. 8 is a partial sectional view of a shroud of an actuator joined with an attachment ring disposed at the neck of an outer container.
Figure 9:
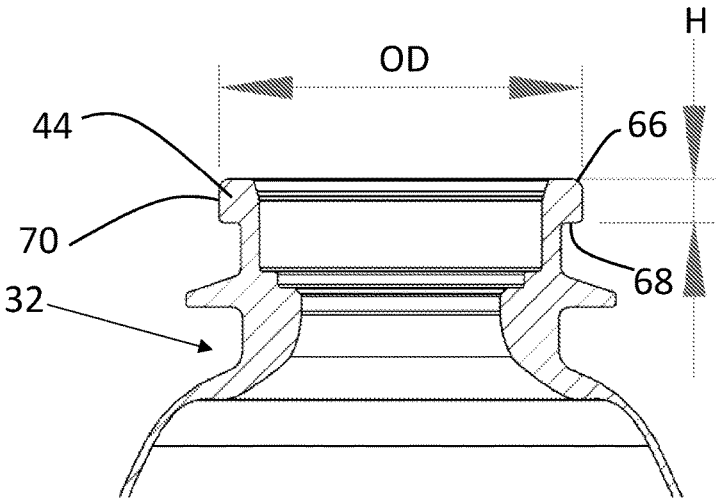
FIG. 9 is a partial sectional view of a neck of an outer containing having an attachment ring.

With reference to FIGS. 8 and 9, the aerosol dispenser 30 includes an attachment ring 44 for joining the actuator 46 to the aerosol dispenser 30. The attachment ring 44 may include an upper surface 66, a lower surface 68, and may have a radially outermost edge 70 that extends farthest from the longitudinal axis than any other point on the attachment ring 44. The upper surface 66 may include an axially uppermost point that is disposed farthest up along the longitudinal axis than any other point on the upper surface 66. The lower surface 68 may include an axially lowermost point that is disposed farthest down along the longitudinal axis than any other point on the lower surface 68, such as illustrated in FIG. 9. The attachment ring 44 may define an outer diameter OD that is measured from the radially outermost edge 70 of the attachment ring 44, such as illustrated in FIG. 9. The attachment ring 44 may define a height H extending from the axially uppermost point on the upper surface 66 to the axially lowermost point on the lower surface 68 of the attachment ring 44

Figure 10:
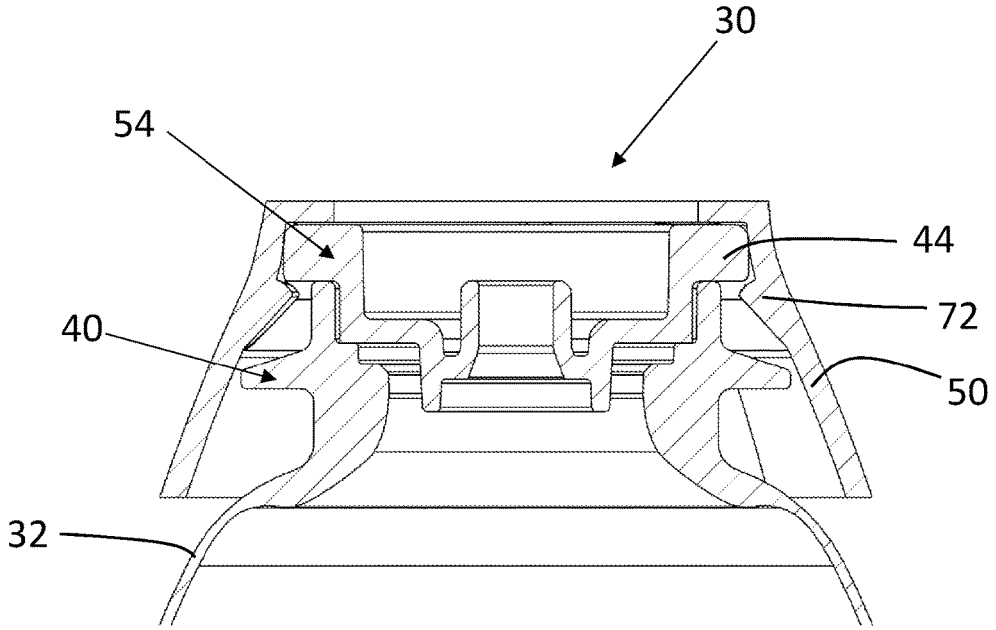
FIG. 10 is a partial sectional view of a neck of a shroud of an actuator joined with an attachment ring disposed on a valve cup that is joined with a neck of an outer container.

With reference to FIGS. 8 and 9, the attachment ring 44 may be integral with and extend from the neck 40 of the outer container 32. With reference to FIG. 10, the attachment ring 44 may be integral with and extend from the valve cup 54.

Figure 4:
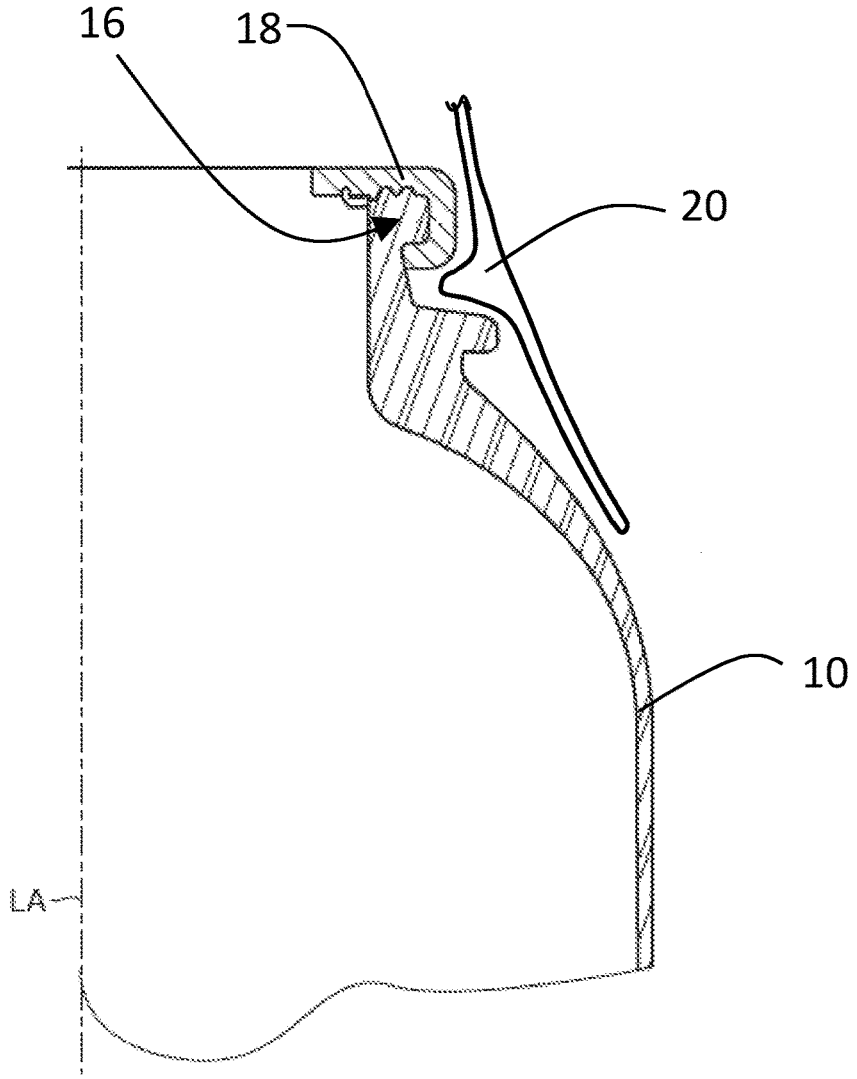
FIG. 4 is a partial sectional view of a prior art aerosol dispenser having an actuator secured with a valve cup that is crimped onto a crimp ring of an outer container.

With reference to FIGS. 8 and 10, the actuator 29 may be depressible, operable as a trigger, push-button, and the like, to spray a product from the aerosol dispenser 20. The actuator 46, such as shown in FIGS. 4, 8, and 10, may include a connector 72 such as a male or female connector, snap-fit connector, or the like to secure the actuator 29 with the attachment ring 44. The actuator may include a shroud 50. The shroud 50 may include the connector or a portion thereof for connecting with the attachment ring 44.

In order to fit a standard, universal actuator onto a plastic aerosol that is to be used with a plastic valve and/or valve cup, the attachment ring 44 has an outer diameter OD in the range of 32.20 mm to 32.80 mm, preferably 32.30 mm to 32.70 mm, more preferably 32.40 mm to 32.60 mm, and a height H of 3.60 mm to 4.40 mm, preferably 3.80 mm to 4.20 mm, more preferably 3.90 mm to 4.10 mm. By sizing the attachment ring 44 with such dimensions, actuators used today with metal valve cups that are crimped onto plastic or metal outer containers can be used with new aerosol dispensers having a plastic valve cup and/or plastic valve that are joined with a plastic outer container.

With reference to FIG. 6, the valve 52 may provide for dispensing from the top of the product delivery device, through one or more ports, and into the valve stem. Optionally, the valve 52 may have a bypass outside the ports to accommodate relatively viscous product.

Referring back to FIGS. 6-7, the product delivery device 56 may be used to contain and/or provide for delivery of product 82 from the aerosol dispenser 20 upon demand. Suitable product delivery devices 56 comprise pistons, bags such as illustrated in FIG. 7, or dip tubes such as illustrated in FIG. 6. If desired, the product delivery device 56 may further comprise a metering device for dispensing predetermined, metered quantities of product 82. The product delivery device 56 may also comprise an inverting valve having a ball therein to alter product 82 flowpath.

If desired the product delivery device 56 may comprise a dip tube disposed in a bag. Such a dip tube may reach to nearly the bottom of the bag, or be juxtaposed near the middle of the bag.

If desired, all or some of the components of the aerosol dispenser 30 may be made of plastic. The outer container 32, valve cup 54, valve 52, and/or piston may be polymeric. By polymeric it is meant that the component is formed of a material which is plastic, comprises polymers, and/or particularly polyolefin, polyester or nylons, and more particularly PET. Thus, the entire aerosol dispenser 30 or, specific components thereof, may be free of metal. The outer container 32, and all other components, may comprise, consist essentially of or consist of PET, PEN, Nylon, EVOH or blends thereof to meet DOT SP 14323.

All or substantially all of the components of the aerosol dispenser, excluding the propellant and product, may be configured to be accepted in a single recycling stream.

All such materials, or a majority of the components of the aerosol dispenser 30 (excluding the propellant and product) may be comprised of a single class of resin according to ASTM D7611. Particularly, all components, or a majority of the components, of the aerosol dispenser 30 may comprise the aforementioned TPE and PET/PETE, Resin Identification Code 1/01.

The outer container 32, and/optionally the product delivery device 56 may be transparent or substantially transparent. This arrangement provides the benefit that the consumer knows when product is nearing depletion and allows improved communication of product attributes, such as color, viscosity, etc. Also, labeling or other decoration of the container may be more apparent if the background to which such decoration is applied is clear. Suitable decoration includes labels. Labels may be shrink wrapped, printed, etc., as are known in the art.

The outer container 32 may be axisymmetric as shown, or, may be eccentric. While a round cross-section is shown, the invention is not so limited. The cross-section may be square, elliptical, irregular, etc. Furthermore, the cross section may be generally constant as shown, or may be variable. If a variable cross-section is selected, the outer container may be barrel shaped, hourglass shaped, or monotonically tapered.

The outer container 32 may range from 6 cm to 60 cm, and particularly 10 cm to 40 cm in height, taken in the axial direction and from 3 cm to 60 cm, and particularly 4 cm to 10 cm in diameter if a round footprint is selected. The outer container may have a volume ranging from 40 cubic centimeters to 1000 cubic centimeters exclusive of any components therein, such as a product delivery device 56. The outer container may be injection-stretch blow molded. If so, the injection-stretch blow molding process may provide an overall stretch ratio of greater than 8, 8.5, 9, 9.5, 10, 12, 15 or 20 and less than 50, 40 or 30.

The outer container 32 may sit on a base. The base is disposed on the bottom of the outer container 32. Suitable bases include petaloid bases, champagne bases, hemispherical or other convex bases used in conjunction with a base cup. Or the outer container 32 may have a generally flat base with an optional punt.

At 21° C., the outer container 32 may be pressurized to an internal gage pressure of 100 kPa to 1300 kPa, 110 kPa to 490 kPa or 270 kPa to 420 kPa. An aerosol dispenser 20 may have an initial propellant pressure of 1100 kPA and a final propellant pressure of 120 kPa, an initial propellant pressure of 900 kPA and a final propellant pressure of 300 kPa, an initial propellant pressure of 500 kPA and a final propellant pressure of 0 kPa, and any values therebetween.

A seal may be used to sealingly join any of the components of the aerosol dispenser. A seal made of class 1 TPE material. Polyester based TPE sold by Kraiburg TPE GmbH & Co KG of Waldkraiburg, Germany under the name HTC8791-52 and sold by DuPont of Delaware under the name HYTEL may be used for good resistance to Silicone and adhesion to PET. Such a TPE material is believed to fall under Resin Identification Code 1/01 for PETE/PET, as set forth above by the Society of Plastics Industry and ASTM D7611. Or a Styrenic bloc copolymer based TPE such as Kraiburg HTC8791-24 or Krayton elastomer may be used, providing easier process and lower density. Other seal materials include silicone, rubber and similar conformable materials.

A permanent seal may be used to join any or all of the plastic components of the aerosol dispenser 30. Particularly, if the components have compatible melt indices, such components may be sealed by welding to retain propellant therein. Suitable welding processes may include sonic, ultrasonic, spin, and laser welding. Welding may be accomplished with a commercially available welder, such as available from Branson Ultrasonics Corp. of Danbury, Conn. Alternatively or additionally, the channel may prophetically be blocked by a plug or sealed by adhesive bonding. Suitable sealing processes for the channel are particularly described in commonly assigned U.S. Pat. No. 8,869,842.

Spin welding has been found to be particularly preferred. Spin welding provides the benefit that the energy plane is generally confined to a small vertical space, limiting unintended damage of other components not intended to be welded or receive such energy.

Figure 11:
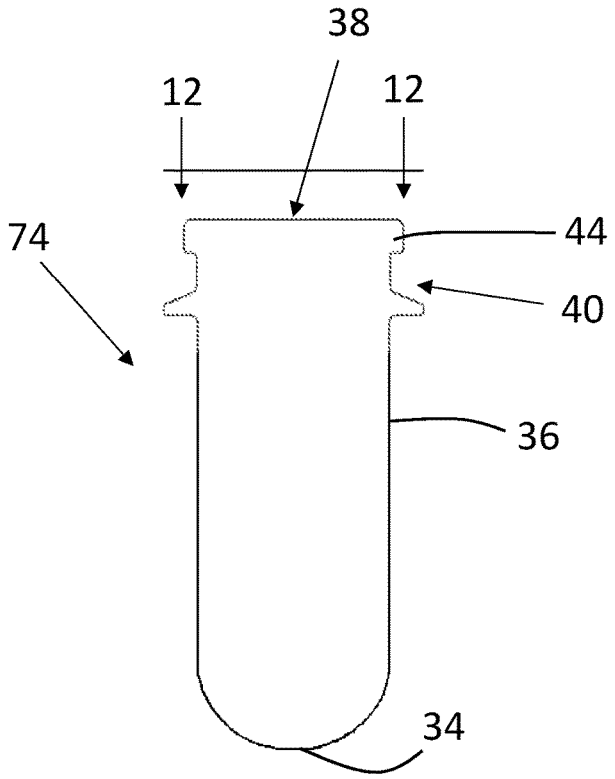
FIG. 11 is a side elevation view of a preform having an attachment ring.
Figure 12:
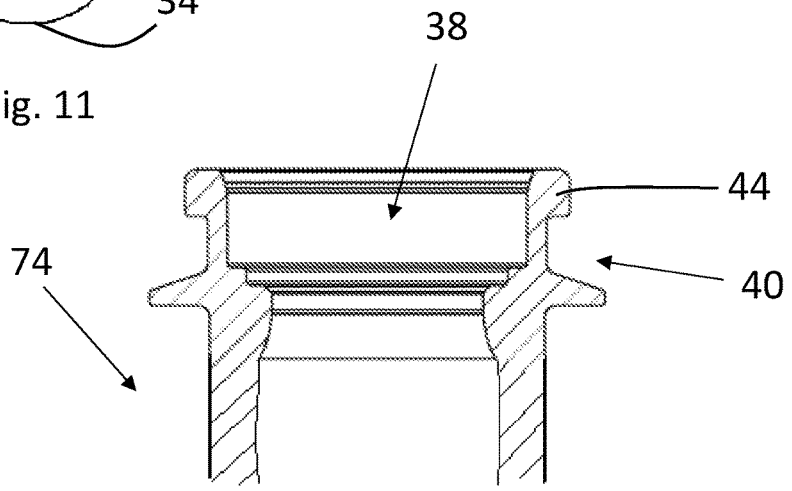
FIG. 12 is a partial sectional view of FIG. 11 taken along lines 12-12.

With reference to FIGS. 11 and 12, the outer container 32 may be blown from a preform 74. The preform 74 may include a neck 40 defining an opening 38, a sidewall 36, and a closed bottom 34 opposite the neck 40.

The preform 74 may include the attachment ring 44. The attachment ring 44 may define an outer diameter OD that is measured from the radially outermost edge 70 of the attachment ring 44. The attachment ring 44 may define a height H extending from the axially uppermost point on the upper surface 66 to the axially lowermost point on the lower surface 68 of the attachment ring 44.

In order to fit a standard, universal actuator onto a polymeric outer container 32 that is to be used with a polymeric valve and/or valve cup, the attachment ring 44 of the preform 74 has an outer diameter OD in the range of 32.20 mm to 32.80 mm, preferably 32.30 mm to 32.70 mm, more preferably 32.40 mm to 32.60 mm, and a height H of 3.60 mm to 4.40 mm, preferably 3.80 mm to 4.20 mm, more preferably 3.90 mm to 4.10 mm. By sizing the attachment ring 44 of the preform 74 with such dimensions, actuators used today with metal valve cups that are crimped onto plastic or metal outer containers can be used with new aerosol dispensers having a plastic valve cup and/or plastic valve that are joined with a plastic outer container.

A preform 74 can be made in a single injection molding operation, providing tolerances suitable for mass production. Then, the preform can be blow-molded in known fashion to make the outer container 32. One of skill will understand the blow molding step may also include stretching as is known in the art.

Figure 13:
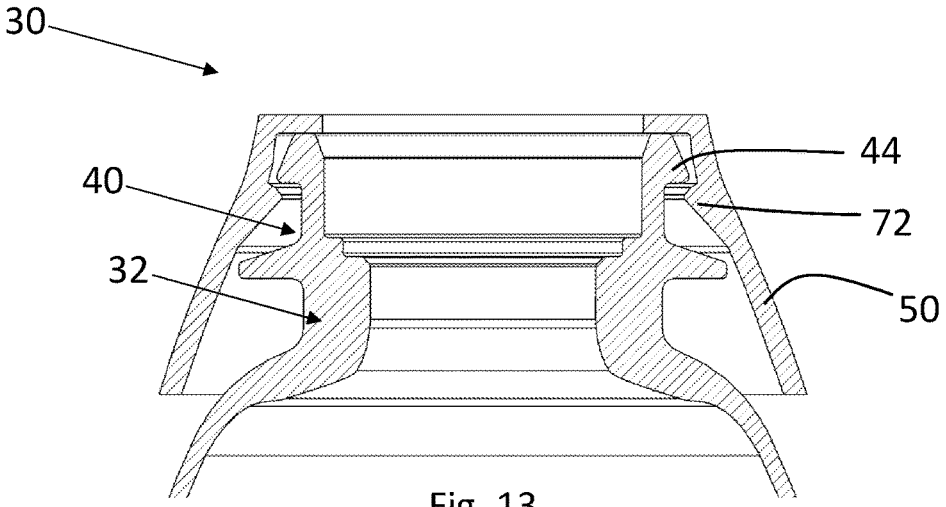
FIG. 13 a partial sectional view of a shroud of an actuator joined with an attachment ring disposed at the neck of an outer container.
Figure 14:
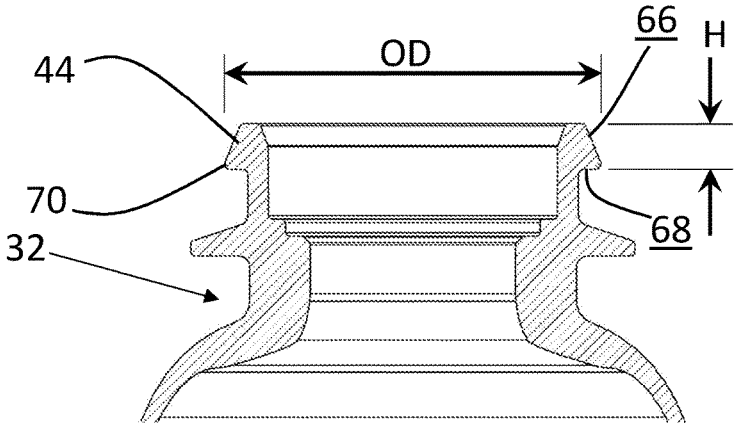
FIG. 14 is a partial sectional view of a neck of an outer containing having an attachment ring with a sloped upper surface.

With reference to FIGS. 13 and 14, the upper surface 66 of the attachment ring 44 may be sloped downward toward the radially outermost edge 70. By sloping the upper surface 66, the process of attaching the shroud 50 of the actuator with the attachment ring 44 may be improved. In the case of a snap-fit type connector on the actuator, such as shown in FIG. 13, sloping the upper surface 66 may allow for a gradual transition of the shroud to deflect away from the attachment ring, and then snap into place once the connector element of the shroud clears the attachment ring.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package, wherein the package comprises:

a polymeric outer container, the polymeric outer container having a closed bottom, a sidewall, a neck opposite the closed bottom and defining an opening for receiving product, the polymeric outer container having a longitudinal axis;

a valve joined with opening of the polymeric outer container, wherein the valve comprises a polymeric valve cup, wherein the polymeric valve cup comprises an attachment ring disposed adjacent to the neck of the outer container and extending beyond the neck of the outer container, wherein the attachment ring has a radially outermost edge from the longitudinal axis that defines an outer diameter of the attachment ring; and an actuator joined with the polymeric attachment ring.

2. The package of claim 1, wherein the package comprises a product delivery device disposed at least partially within the outer container, the product delivery device selected from the group consisting of a bag, a dip tube, a piston, and combinations thereof.

3. The package of claim 2, comprising propellant disposed in the polymeric outer container and in operable relationship with the product delivery device.

4. The package of claim 1, wherein the polymeric valve cup the valve with the polymeric outer container.

5. The package of claim 4, wherein polymeric valve cup is spin-welded to the neck of the outer container.

6. The package of claim 1, wherein the attachment ring has an upper surface and a lower surface disposed below the upper surface relative to the longitudinal axis, wherein the upper surface slopes downward toward the radially outermost edge.

7. The package of claim 1, wherein the attachment ring has an upper surface and a lower surface disposed below the upper surface relative to the longitudinal axis, wherein the upper surface has an axially uppermost point and the lower surface has an axially lowermost point, wherein an axial distance between the axially uppermost point and the axially lowermost point defines a height of the attachment ring, wherein the height is 3.60 mm to 4.40 mm.

8. The package of claim 1, wherein the actuator comprises a snap-fit connector that is releasably connectable with the attachment ring.

9. The package of claim 1, wherein the outer diameter of the attachment ring is 32.50 mm with a standard deviation of +/−0.30 mm.

10. The package of claim 9, wherein the standard deviation is +/−0.20 mm.

11. A package comprising:

a polymeric outer container, the polymeric outer container having a closed bottom, a sidewall, a neck opposite the closed bottom and defining an opening for receiving product, the polymeric outer container having a longitudinal axis;

a valve joined with opening of the polymeric outer container, wherein the valve comprises a polymeric valve cup, wherein the polymeric valve cup comprises an attachment ring disposed adjacent to the neck of the outer container, wherein the attachment ring has a radially outermost edge from the longitudinal axis the that defines an outer diameter of the attachment ring, wherein the outer diameter is 32.20 mm to 32.80 mm, and wherein the attachment ring is directly connectable with an actuator of an aerosol dispenser.

12. The package of claim 11, wherein the package comprises:

an actuator joined directly with the polymeric attachment ring; and a product delivery device disposed at least partially within the outer container, the product delivery device selected from the group consisting of a bag, a dip tube, a piston, and combinations thereof.

13. The package of claim 11, wherein the polymeric valve cup connects the valve with the polymeric outer container.

14. The package of claim 13, wherein polymeric valve cup is spin-welded to the neck of the outer container.

15. The package of claim 11, wherein the outer diameter is 32.40 mm to 32.60 mm.

16. The package of claim 11, wherein the attachment ring has an upper surface and a lower surface disposed below the upper surface relative to the longitudinal axis, wherein the upper surface slopes downward toward the radially outermost edge.

17. The package of claim 11, wherein the attachment ring has an axially uppermost point and an axially lowermost point, wherein an axial distance between the axially uppermost point and the axially lowermost point defines a height of the attachment ring, wherein the height is 3.60 mm to 4.40 mm.

18. The package of claim 11, wherein the outer container is blow-molded from a preform.

19. A package, wherein the package comprises:

a polymeric outer container, the polymeric outer container having a closed bottom, a sidewall, a neck opposite the closed bottom and defining an opening for receiving product, the polymeric outer container having a longitudinal axis;

a valve joined with opening of the polymeric outer container, wherein the valve comprises a polymeric valve cup, wherein the polymeric valve cup comprises an attachment ring disposed adjacent to the neck of the outer container and extending beyond the neck of the outer container; and an actuator secured with the polymeric attachment ring.

* * * * *